US005144192A

United States Patent [19]

Barthelmes

[11] Patent Number: 5,144,192

[45] Date of Patent: Sep. 1, 1992

[54] HIGH-PRESSURE DISCHARGE LAMP

[75] Inventor: Clemens Barthelmes, Berlin, Fed. Rep. of Germany

[73] Assignee: Patent Treuhand Gesellschaft fur elektrische Glunlampen m.b.H., Munich, Fed. Rep. of Germany

[21] Appl. No.: 732,080

[22] Filed: Jul. 18, 1991

[30] Foreign Application Priority Data

Aug. 2, 1990 [DE] Fed. Rep. of Germany ..... 4024603

[51] Int. Cl.[5] ..... H01J 61/30; H01J 61/36

[52] U.S. Cl. ..... 313/318; 313/332; 313/623; 313/634

[58] Field of Search ..... 313/318, 623, 332, 634

[56] References Cited

U.S. PATENT DOCUMENTS

| | | | |
|---|---|---|---|
| 3,025,426 | 3/1962 | Camarata | 313/332 X |
| 3,351,802 | 11/1967 | Gates . | |
| 3,906,275 | 9/1975 | Spiessens et al. | 313/318 |
| 4,469,983 | 9/1984 | Grahmann et al. | 313/318 |
| 4,542,316 | 9/1985 | Hall et al. | 313/623 X |
| 4,612,000 | 9/1986 | English et al. | 313/634 X |
| 4,723,092 | 2/1988 | Heider et al. | 313/332 X |
| 4,979,082 | 12/1990 | Devir | 313/318 X |
| 5,001,395 | 3/1991 | Barthelmes et al. | 313/623 |

FOREIGN PATENT DOCUMENTS

| | | |
|---|---|---|
| 821079 | 11/1951 | Fed. Rep. of Germany . |
| 1050907 | 2/1959 | Fed. Rep. of Germany . |
| 3227380 | 2/1983 | Fed. Rep. of Germany . |
| 1399451 | 4/1965 | France . |
| 1520151 | 2/1968 | France . |
| 2100404 | 12/1982 | United Kingdom . |
| 2103872 | 2/1983 | United Kingdom . |

OTHER PUBLICATIONS

"Electric Discharge Lamps" by John F. Waymouth, M.I.T. Press (1971).

*Primary Examiner*—Palmer C. DeMeo

*Attorney, Agent, or Firm*—Frishauf, Holtz, Goodman & Woodward

[57] ABSTRACT

To prevent electrolytic current flow between adjacent sealing foils (6,7;14, 15) within a pinch seal (10, 13) at the operating temperature of the pinch seal, in operation of the lamp, the pinch seal is formed with a pinch seal section which has a thickness which is reduced with respect to the pinch seal outside of the region between the foils, for example in form of a slit or a notch or a thin quartz glass web of, at the most, 3 mm thickness. This reduced section, thus, has a resistance which is a multiple of the resistance which the pinch seal, between the foils, would have if the pinch seal would be of uniform thickness throughout its cross section; this reduced section (11, 18) starts at the outer terminal end of the pinch seal (10, 13) and extends up to at least about the ends of the foils (6, 7; 14, 15) proximate to said bulb portion.

20 Claims, 2 Drawing Sheets

HIGH-PRESSURE DISCHARGE LAMP

Reference to related publication:
"Electric Discharge Lamps" by John F. Waymouth, M.I.T. Press ('71). German Utility Model DE Gbm 88 05 183.8.
Reference to related patents, the disclosures of which are hereby incorporated by reference:
U.S. Pat. No. 4,723,092,
U.S. Pat. No. 4,469,983,
U.S. Pat. No. 3,654,506, Kühl et al.

FIELD OF THE INVENTION

The present invention relates to discharge lamps, and especially to such lamps which have a single-ended press seal through which two parallel embedded electric leads extend, and between which spurious discharges may occur during operation of the lamp.

BACKGROUND

High-pressure discharge lamps, and particularly high-pressure discharge lamps having a metal halide fill which includes sodium, may, in use of the lamp, be subject to deterioration of the sealing foils due to corrosion. Corrosion attacks may destroy the sealing foils, typically of molybdenum. Attack on the foils causes leakage of the discharge vessel, resulting in failure of the lamp. Corrosion of the sealing foils, it is believed, is caused by thermal diffusion of metal halide compounds from the discharge bulb or vessel into the region of the pinch seal in which the foils are embedded. It has been determined that two adjacently located sealing foils which are at different voltage levels additionally are subjected to corrosion due to yet another effect discussed below. In single-ended lamps, two sealing foils at different voltage levels are located next to each other within a pinch seal.

The book "Electric Discharge Lamps", M.I.T. Press 1971, by John F. Waymouth, states that a direct current voltage may be built between adjacently located foils. The lamp vessel, usually, is quartz glass. Upon heating, quartz glass becomes weakly conductive. Thus, in operation of the lamp, an electrolytic current can flow between the sealing foils. This current causes penetration of metal ions, particularly sodium ions, within the pinch seal, thus causing corrosion of the foils. Both effects are temperature dependent. In lamps of low power, in which the spacing between the sealing foils is small, the second, corrosive, effect is predominant.

German Utility Model 88 05 183 describes a proposed solution to inhibit thermal diffusion of metal halide compounds from the discharge vessel into the region of the pinch seal. The electrode shafts are surrounded in the region of the pinch seal up to the sealing foils by insulating tubes, for example made of quartz glass, which are intended to prevent thermal diffusion of metal halide compounds from the discharge vessel into the region of the pinch seal as much as possible.

THE INVENTION

It is an object to provide a metal halide high-pressure discharge lamp in which the second effect causing corrosion, namely spurious electrolytic current flow between the sealing foils, is effectively essentially inhibited.

Briefly, an arrangement to inhibit, in operation of the lamp, electrolytic current flow between the sealing foils is obtained by so constructing the pinch seal that an elongated axially extending current flow inhibiting region is formed between the foils. The pinch seal is formed with a section which has a thickness which is reduced with respect to the pinch seal outside of this axially extending region; this reduction may be to a thickness of zero, in effect forming a notch or slit between the pinch seals. If a web is left, it should have, at the most, a web thickness of about 0.3 mm.

Basically, the reduced region should have a resistance which is a multiple of the resistance of a prior art pinch seal, at the operating temperature of the lamp, when measured across the sealing foils.

By forming a section having a thickness of zero between the sealing foils within the pinch seal of quartz glass, or with only a very thin web of at the most 0.3 mm thickness, electrolytic current flow between the foils is effectively inhibited during operation of the lamp. Thus, destruction or damage to the foils due to electrolytic current flow and consequent corrosion thereof is effectively prevented.

Various investigations have been made in metal halide high-pressure discharge lamps of such regions or sections of reduced electrical conductivity. Investigations with different shapes or geometry of the regions have shown that the width of the section should at least be 0.05 mm, but it should not exceed a width which is at least 0.2 mm less than the spacing of the foils from each other because, otherwise, there might be leakages or other failures of gas tightness within the region of the foils.

Optimum results were obtained when the section starts at the outer end of the pinch seal and extends up to at least the end of the sealing foil closer to the electrodes. In no case should the section of at the most 0.3 mm thick quartz glass come closer than ½ mm to the side at the end of the pinch seal which is proximate to the electrodes since, otherwise, it is difficult or impossible to obtain sufficient gas tightness of the discharge space.

The current flow inhibiting region can be formed in different ways. If the stability of the discharge vessel or, respectively, of the pinch seal permits formation of the region as a notch or a slit, then it is possible to first make a complete pinch seal and then separate the region between the foils by a separating disk or by cutting with a cutter disk or a laser to obtain the requisite shape and geometry of the current flow inhibiting region. If, however, a web is to be left, for example having a thickness of at the most 0.3 mm, then the geometry of the pinch jaws can be suitably selected so that the pinch seal will, as it is formed, provide for thickened portions surrounding the connecting foils, while having only a thin connecting web.

DRAWINGS

FIG. 1 is a highly schematic side view of a discharge lamp having the pinch seal in accordance with the present invention; and FIG. 2 is a bottom view of the lamp in which a connecting web is left in the pinch seal, extending between the foils.

DETAILED DESCRIPTION

Figure 1:
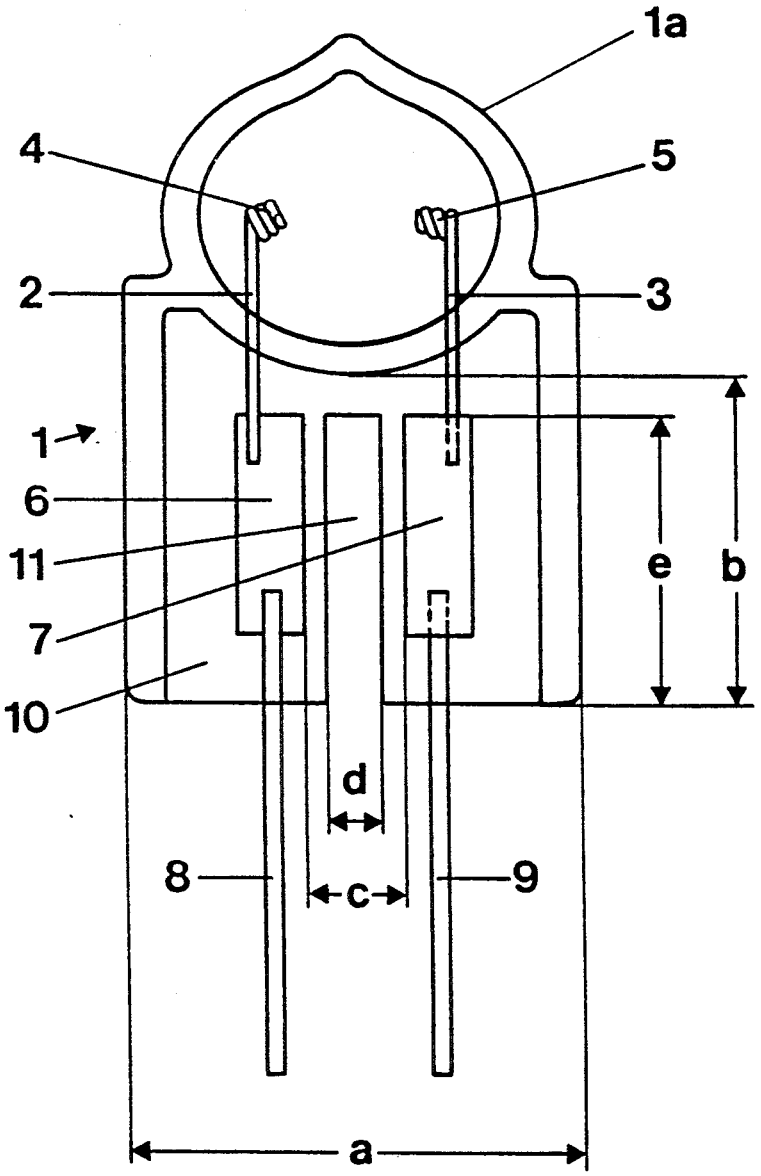

Referring first to FIG. 1, which is a side view of a single-ended high-pressure metal halide discharge lamp, and having the pinch seal in accordance with the present invention. The discharge lamp 1 has a discharge vessel 1*a* formed of quartz glass, within which two tungsten electrodes are located. Each tungsten electrode has a respective head 4, 5, and an electrode shaft 2, 3. The electrodes are made of a single wire. The free ends, that is the lower ends in FIG. 1, of the electrode shafts 2, 3 are welded to molybdenum sealing foils 6, 7. The other ends of the sealing foils 6, 7 are welded to tungsten terminal leads 8, 9. The two electrode shafts 2, 3, the foils 6, 7, and the terminal leads 8, 9 are located essentially parallel to each other.

The discharge vessel 1*a* is closed off by a pinch seal 10 in which the ends of the electrode shafts 2, 3, the sealing foils 6, 7 and the ends of the terminal leads 8, 9 are pinched and sealed.

In accordance with a feature of the invention, and to prevent electrolytic current flow in operation of the lamp between the sealing foils 6, 7, the pinch seal 10 is formed with a section 11 free from quartz glass. That section 11, in the form of a notch or a slit, has essentially rectangular outline and dimensions. The notch 11 starts at the outer end of the pinch seal 10 and extends with longitudinal sides parallel to the terminal leads 8, 9 and the sealing foils 6, 7.

The lamp includes a fill which has a noble gas, metal halides and mercury. The metal halides may include sodium.

The table forming part of this specification describes suitable dimensional relationships for metal halide high-pressure discharge lamps, giving the dimensions for the pinch seal, the molybdenum sealing foils, and an optimal size for the notch 11.

TABLE

| Discharge Vessel | Pinch Seals | | Sealing Foils | | Clear | Region without Quartz Glass | |
|---|---|---|---|---|---|---|---|
| Rated power | Width a | Length b in the region free from quartz glass | Width | Length | Spacing c | Width d | Length e |
| 35 W | 11–12 mm | 11–12 mm | 2.0 mm | 7 mm | 2.6 mm | 1.0 mm | 9 mm |
| 70 W | 13–14 mm | 12–13 mm | 2.0 mm | 9.5 mm | 3.7 mm | 1.5 mm | 10.5 mm |
| 150 W | 17–18 mm | 13–14 mm | 3.0 mm | 9.5 mm | 4.8 mm | 2.0 mm | 11 mm |

Figure 2:
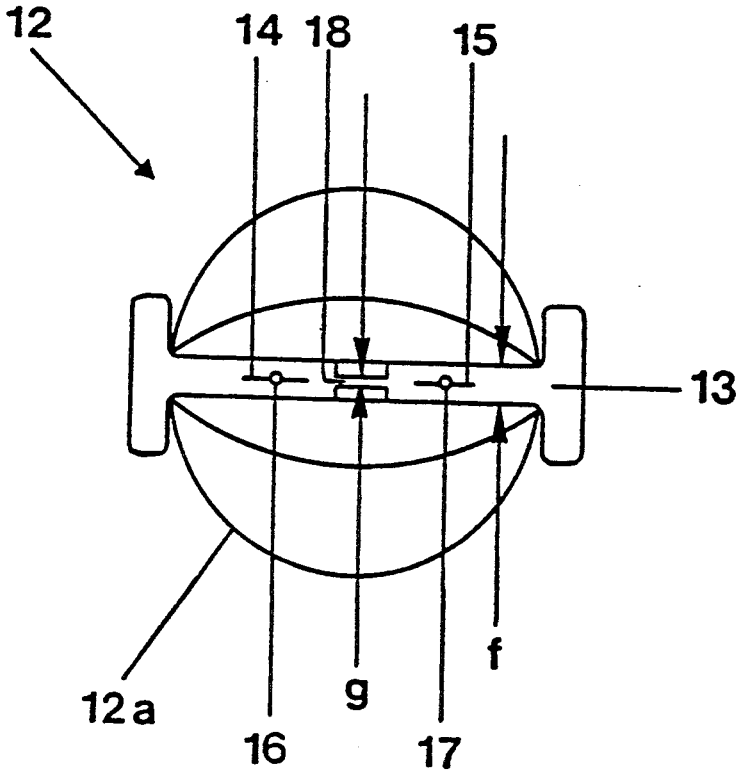

FIG. 2 is a bottom view of another embodiment of a lamp having an arrangement to inhibit electrolytic current flow in operation of the lamp. The lamp has a discharge vessel 12*a*, closed off by a pinch seal 13. The pinch seal 13 has generally I-shaped cross section, closing off the bulb or vessel 12*a*. Molybdenum foils 14, 15 and current supply leads 16, 17 of the electrodes are pinch-sealed in the pinch seal 13. The portion of the pinch seal 13 in which the molybdenum foils 14, 15 are embedded has a thickness f. In the center of the pinch seal 13 and between the sealing foils 14, 15 and the current supply leads 16, 17, an essentially (in plan view) rectangular cross section 18 is provided, in which the pinch seal has a thickness g of up to only about 0.3 mm. This portion 18, thus, forms a web between the foils 14, 15 of substantially increased resistance with respect to the section having the thickness f.

Various changes and modifications may be made within the scope of the inventive concept, and the invention is equally applicable to lamps of other types and dimensions than those specifically described.

I claim:

1. A single-ended pinch-sealed lamp (1, 12) having a quartz envelope defining a lamp axis, said envelope forming a bulb portion (1*a*, 12*a*) and a connecting portion, said connecting portion being unitary with the bulb portion and forming a pinch seal (10, 13) closed off at the bulb portion;

two electrode shafts (2, 3) extending into the bulb portion;

two terminal leads (8, 9; 16, 17) extending outwardly of the pinch seal (10, 13);

two sealing foils (6, 7; 14, 15) connecting said electrode shafts (2, 3) and said terminal leads (8, 9; 16, 17) and melted gas-tightly into said pinch seal; and a fill including a metal halide compound which, in operation of the lamp, becomes vaporized within said bulb portion, and comprising an arrangement for inhibiting, in operation of the lamp, electrolytic current flow between said sealing foils, which is characterized by an elongated, essentially axially extending current flow inhibiting region located between said foils (6, 7; 14, 15) and including a pinch seal section (11, 18) formed in said pinch seal (10, 13) having a thickness which is reduced with respect to the pinch seal outside of said region, said thickness being between 0 and, at most, 0.3 mm, which pinch seal section (11, 18) starts at the outer terminal end of the pinch seal (10, 13) and extends up to at least about the ends of the foils (6, 7; 14, 15) proximate to said bulb portion.

2. The lamp of claim 1, wherein said pinch seal section is formed as an open notch (11).

3. The lamp of claim 1, wherein said pinch seal section is formed as a thin web (18) of quartz glass of up to 0.3 mm thickness.

4. The lamp of claim 1, wherein said section (11, 18) has a width (d) of at least 0.05 mm.

5. The lamp of claim 1, wherein said section (11, 18) has a width (d) which is at least 0.2 mm smaller than the minimum spacing (c) of adjacent sealing foils (6, 7; 14, 15).

6. The lamp of claim 1, wherein said section (11, 18) terminates at least 0.5 mm in advance of the end of the pinch seal (10, 13) proximate to said bulb portion.

7. The lamp of claim 1, wherein said fill includes a noble gas, metal halides and mercury.

8. The lamp of claim 7, wherein said metal halides include sodium.

9. The lamp of claim 1, wherein said pinch seal section is formed as a slit.

10. The lamp of claim 1, wherein said two sealing foils extend essentially parallel within said pinch seal.

11. A single-ended pinch-sealed lamp (1, 12) having a quartz envelope defining a lamp axis, said envelope forming a bulb portion (1*a*, 12*a*) and a connecting portion, said connecting portion being unitary with the bulb portion and forming a pinch seal (10, 13) closed off at the bulb portion;

two electrode shafts (2, 3) extending into the bulb portion;

two terminal leads (8, 9; 16, 17) extending outwardly of the pinch seal (10, 13);

two sealing foils (6, 7; 14, 15) connecting said electrode shafts (2, 3) and said terminal leads (8, 9; 16, 17) melted gas-tightly into said pinch seal; and a fill including a metal halide compound which, in operation of the lamp, becomes vaporized within said bulb portion, and comprising an arrangement for inhibiting, in operation of the lamp, electrolytic current flow between said sealing foils, which is characterized by an elongated, essentially axially extending current flow inhibiting region located between said foils (6, 7; 14, 15) and including a pinch seal section (11, 18) formed in said pinch seal (10, 13) having a resistance which is a multiple of the resistance of quartz glass in said section of the thickness of the pinch seal in the region of the foils, at the operating temperature of the pinch seal when the lamp is in operation, which pinch seal section (11, 18) starts at the outer terminal end of the pinch seal (10, 13) and extends up to at least about the ends of the foils (6, 7; 14, 15) proximate to said bulb portion.

12. The lamp of claim 11, wherein said pinch seal section (11) comprises an air gap.

13. The lamp of claim 11, wherein said pinch seal section (18) comprises a section of reduced thickness of said pinch seal.

14. The lamp of claim 11, wherein said pinch seal section (18) comprises a web section of up to 0.3 mm thickness of quartz glass material.

15. The lamp of claim 11, wherein said pinch seal section includes an insulating means between adjacent edges of the foil.

16. The lamp of claim 15, wherein said insulating means comprises an air gap.

17. The lamp of claim 11, wherein said two sealing foils extends essentially parallel within said pinch seal.

18. The lamp of claim 12, wherein said two sealing foils extend essentially parallel within said pinch seal.

19. The lamp of claim 13, wherein said two sealing foils extend essentially parallel within said pinch seal.

20. The lamp of claim 14, wherein said two sealing foils extend essentially parallel within said pinch seal.

* * * * *